US005966774A

United States Patent [19]

Bone et al.

[11] Patent Number: 5,966,774

[45] Date of Patent: Oct. 19, 1999

[54] HAND-HELD VACUUM CLEANER

[75] Inventors: Daniel Bone, Langley Moor; Mark Stratford, Darlington, both of United Kingdom

[73] Assignee: Black & Decker, Inc., Newark, Del.

[21] Appl. No.: 08/980,754

[22] Filed: Dec. 1, 1997

[30] Foreign Application Priority Data

Nov. 30, 1996 [GB] United Kingdom ..... 9624982

[51] Int. Cl.[6] ..... A47L 5/24

[52] U.S. Cl. ..... 15/344; 15/350; 15/352

[58] Field of Search ..... 15/344, 347, 352, 15/350; 55/366, 370, 428, 432, DIG. 3

[56] References Cited

U.S. PATENT DOCUMENTS

| | | | |
|---|---|---|---|
| 4,209,875 | 7/1980 | Pugh et al. | 15/344 |
| 4,577,365 | 3/1986 | Yuen | 15/350 |
| 4,745,654 | 5/1988 | Yamamoto et al. | 15/347 |
| 4,920,608 | 5/1990 | Hult et al. | 15/344 |
| 4,967,443 | 11/1990 | Krasznai et al. | 15/347 |
| 5,025,529 | 6/1991 | Hult et al. | 15/344 |
| 5,134,751 | 8/1992 | Reed, Jr. et al. | 15/347 |

*Primary Examiner*—Terrence R. Till
*Assistant Examiner*—Andrew Aldag
*Attorney, Agent, or Firm*—Ajay K. Gambhir

[57] ABSTRACT

A hand-held vacuum cleaner comprises first and second portions which can be pivotally separated in order to allow the filter mechanism to be cleared of debris. The two portions are pivotally connected via a hinge such that on separation, the portion moves to a position below the other portion and provides a chute for guidance of the debris which is then emptied from the filter.

13 Claims, 3 Drawing Sheets

HAND-HELD VACUUM CLEANER

BACKGROUND OF THE INVENTION

The present invention relates to a hand-held vacuum cleaner of the type which comprises a housing for accommodating an electric motor operable to drive a fan, which fan, when driven, causes an influx of air to the vacuum cleaner through a first opening in the housing, via a filter means, to a second opening in the housing for efflux from the housing; wherein the housing includes first and second pivotally connected portions which may be pivotally separated in order to remove debris from the filter means.

A vacuum cleaner of the above kind is known, for example, from U.S. Pat. No. 4,745,654. This document shows a cleaner having a removable debris (or dust) bag which sits in a housing of the cleaner. During use of the cleaner, debris collects in this filter bag and makes operation of the cleaner less and less efficient as more and more debris collects therein. This is because filtering of the influx air is caused by passing this dirt-laden air through the filter which is formed from a woven fibrous material. As the dirt-laden air is forced through the filter, debris is caught by the fibres and so clean air is passed out of the cleaner via the housing on the other side of the filter to where the debris is caught. It is clearly desirable, therefore to allow the user of the cleaner to have easy access to the filter bag in order to be able to remove it from its seat and periodically clear it of debris.

In the above document, removal of the filter bag is achieved by firstly lifting a portion of the housing of the vacuum cleaner away form the rest of the housing to expose a dust case. The dust case is seated in a recess formed in inside of the housing and itself comprises a pivotal lid below which is the filter. The filter comprises a sheet of cloth-like material held in a semi-rigid framework. The pivotal lid of the dust case is then lifted up to expose the filter which can then be removed and turned upside down to allow the debris therewithin to fall out.

Whilst the above operation functions efficaciously, there are at least four separate movements necessary to empty the filter of debris. Also, both the portion of the housing and the lid of the dust case which need to be moved before the filter may be emptied, are lifted upwards and then stand vertically proud of the vacuum cleaner. The user of the vacuum cleaner thus has to hold the entire unit upright and steady in order to be able to perform the above tasks to empty the debris from the filter. Clearly this does not make for a particularly easily achieved and easily operable filter cleaning process.

It is an object of the present invention to reduce or substantially obviate the abovementioned disadvantages.

BRIEF SUMMARY OF THE INVENTION

The present invention provides a hand-held vacuum cleaner comprising: a housing for accommodating an electric motor operable to drive a fan, which fan, when driven, causes an influx of air to the vacuum cleaner through a first opening in the housing, via a filter, to a second opening in the housing for efflux from the housing; wherein the housing includes first and second pivotally connected portions which may be pivotally separated in order to remove debris from the filter, characterised in that the pivotal separation causes one of the portions to move relative to the other portion and to provide a chute through which debris from the filter may pass.

By enabling the portion of the housing which needs to be moved in order to allow emptying of the debris filter to act as a chute for directing ejection of the debris from the unit, then a more simple and easily operable construction is achieved than has been hitherto available.

BRIEF DESCRIPTION OF THE SEVERAL VIEWS OF THE DRAWINGS

The present invention will now be described, by way of example only and with reference to the accompanying drawings, of which.

DETAILED DESCRIPTION

Figure 1:
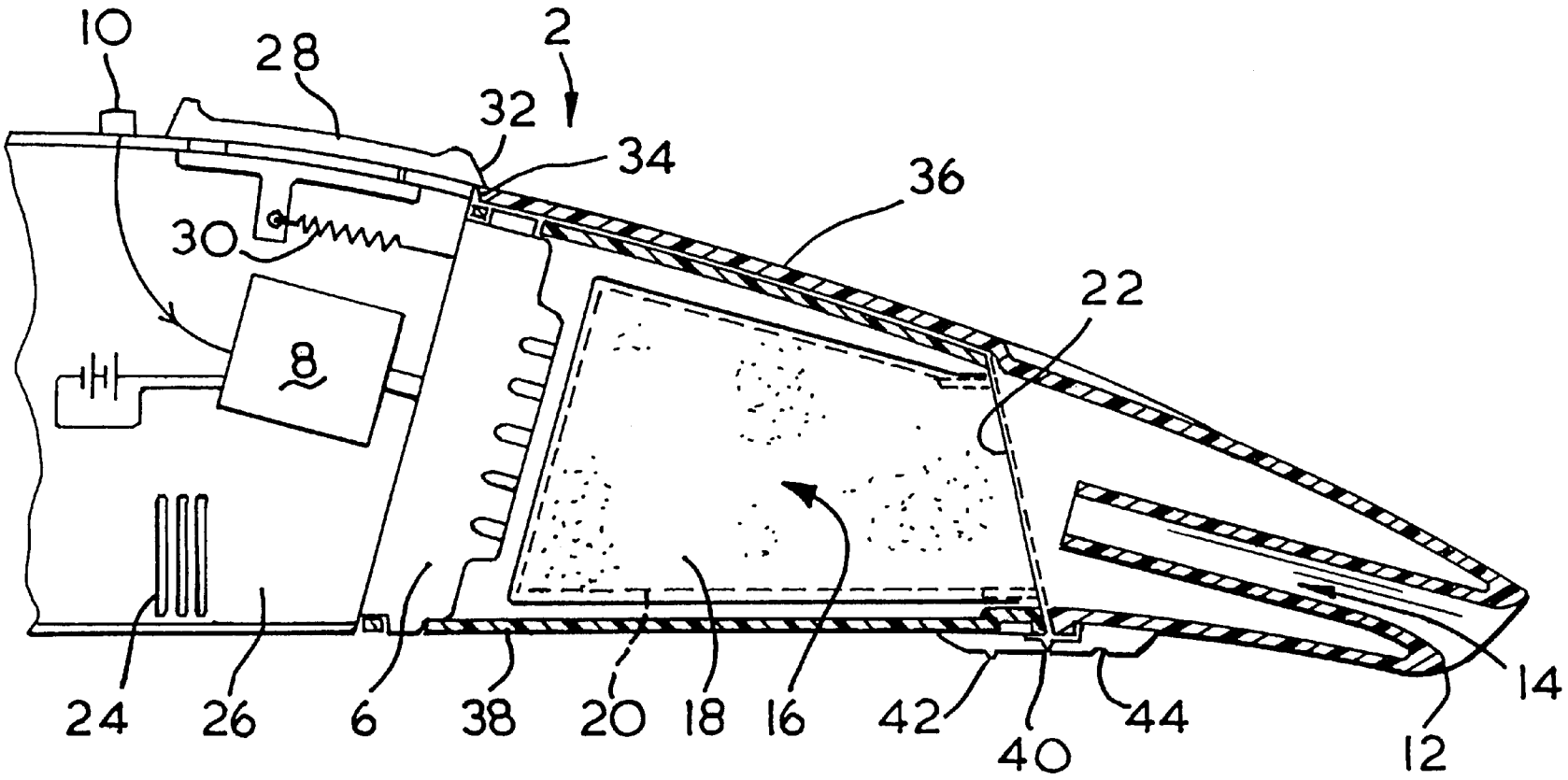
FIG. 1 illustrates schematically a side part-section of a hand-held vacuum cleaner in accordance with the present invention.

Referring firstly to FIG. 1 it will be seen that the hand-held vacuum cleaner of the present invention comprises a housing shown generally as 2. The housing 2 is actually formed of several sections, each of which enables control of air flow through the vacuum cleaner. Air flow itself is generated by a fan 6 which is controlled by an electric motor 8 in conventional manner. The user of the vacuum cleaner operates it by means of on/off switch 10. When the switch 10 is in the "on" position, the motor 8 operates the fan 6 which causes a flow of air through the inside of the housing 2 from right to left as one views the Figure. Air is drawn into the right-hand side of the housing 2 via a first opening in the housing, here a section 12 which is shaped to form a channel 14 defining an influx path for dirt- and debris-laden air. The debris-laden air in the channel 14 moves only in the direction shown by the arrow (as the fan 6 is only operable in one sense) and on into a chamber 16 within which a filter means, in this example a cloth surface, 18, which is stretched over a box-shaped frame 20. The frame 20 serves to hold the cloth 18 taut and also supports the cloth 18 so that it presents an open box to the influx debris-laden air coming via channel 14. Indeed, the box so formed only has an opening at the side thereof which communicates directly with the end of the channel 14. This can be readily seen as the right-hand side of the chamber 16 in the Figure shown by reference numeral 22.

Debris-laden air entering the chamber 16 has been sucked thereinto by the fan 6. The fan 6 thus also causes the air to be urged through the cloth filter 18 and on, via the fan itself, into a further body portion, 26, for efflux via a second opening, in this example air vents, 24, in the housing. It will be understood that, as the debris-laden air is drawn through the cloth filter 18, the particles of debris which are not small enough to pass through the gaps in the weave of the cloth are trapped within the chamber 16 on the inside surface of the cloth 18 in conventional manner. Thus air passing through the cloth filter 18 is cleaned of debris.

It will be apparent that, during prolonged use of a hand-held vacuum cleaner in accordance with the present invention, the chamber 16 may become full of debris, or the gaps in the weave of the cloth filter 18 may become clogged with debris. In this event, it will be necessary to clean the filter means and this is achieved as will be described below and with reference now also to FIG. 2.

In order for the user of the vacuum cleaner to clean the filter 18, a releasable detent means, in this example slide lock 28, is activated. The slide lock 28 includes a biasing spring 30 coupled at one end thereof to the underside of the slide lock 28 and at the other end thereof to the inside of the housing 2. The slide lock 28 has its rest position (as is shown in FIG. 1) such that the biasing spring 30 urges the lock 28 to the right as one views the Figures. This means that, in the rest position, the right hand edge, 32, of the lock 28 overhangs the left hand edge, 34, of one portion of the housing 2, in this example pivotally moveable portion 36. The portion 36 is pivotally connected to a second portion of the housing 2, here, body portion 38, via a pivotal connection, here a plastics hinge 40.

In order for the user to pivotally separate the two portions 36 and 38 of the housing 2, the slide lock 28 is manually urged to the left as one views the Figures. This causes the end 32 of the lock 28 to slide clear of the end 34 of the portion 36 thus allowing the entire portion 36 to pivot (in a clockwise moment as one views the Figures) about the hinge 40. If the user now releases the slide lock 28, the biasing spring 30 will cause it to return to its rest position. Clearly, though, the portion 36 will still be in the position shown in FIG. 2.

The hinge 40 is advantageously formed so as to have a corresponding lug 42 and recess 44 in opposing sides thereof. Thus, when the portion 36 is pivotally separated from the other portion 38, then the lug 42 and recess 44 can mate together in order to hold the two portions 36 and 38 together, but in their pivotally separated state. This is useful because it prevents the two portions 36 and 38 from swinging freely relative to each other.

When the user has separated the two portions 36 and 38, then it is a simple matter to remove the filter 18 for cleaning, if the user wishes to do this. This, of course, is the manner in which cleaning of the filter is achieved in the prior art. With the present invention, however, the need to physically remove the filter 18 from the chamber 16 within which it sits is obviated due to the fact that the pivotally moved portion 36 now presents and defines a chute along which the user may channel and direct debris form the filter 18 simply under the action of gravity. The chute, depicted generally as 46 in FIG. 2, acts as a channel via which the debris removed from the filter 16 may be directed to a suitable receptacle, such as a waste bin or the like. In the event that some debris within the filter 16 is difficult to remove simply by holding the device upside down, then if the user holds the two portions 36, 38 locked in their separated position by way of the lug 42 and recess 44 on the hinge 40, then a jolting, shaking or jarring action may be imparted to the device in order to remove this stubborn-held debris.

Figure 2:
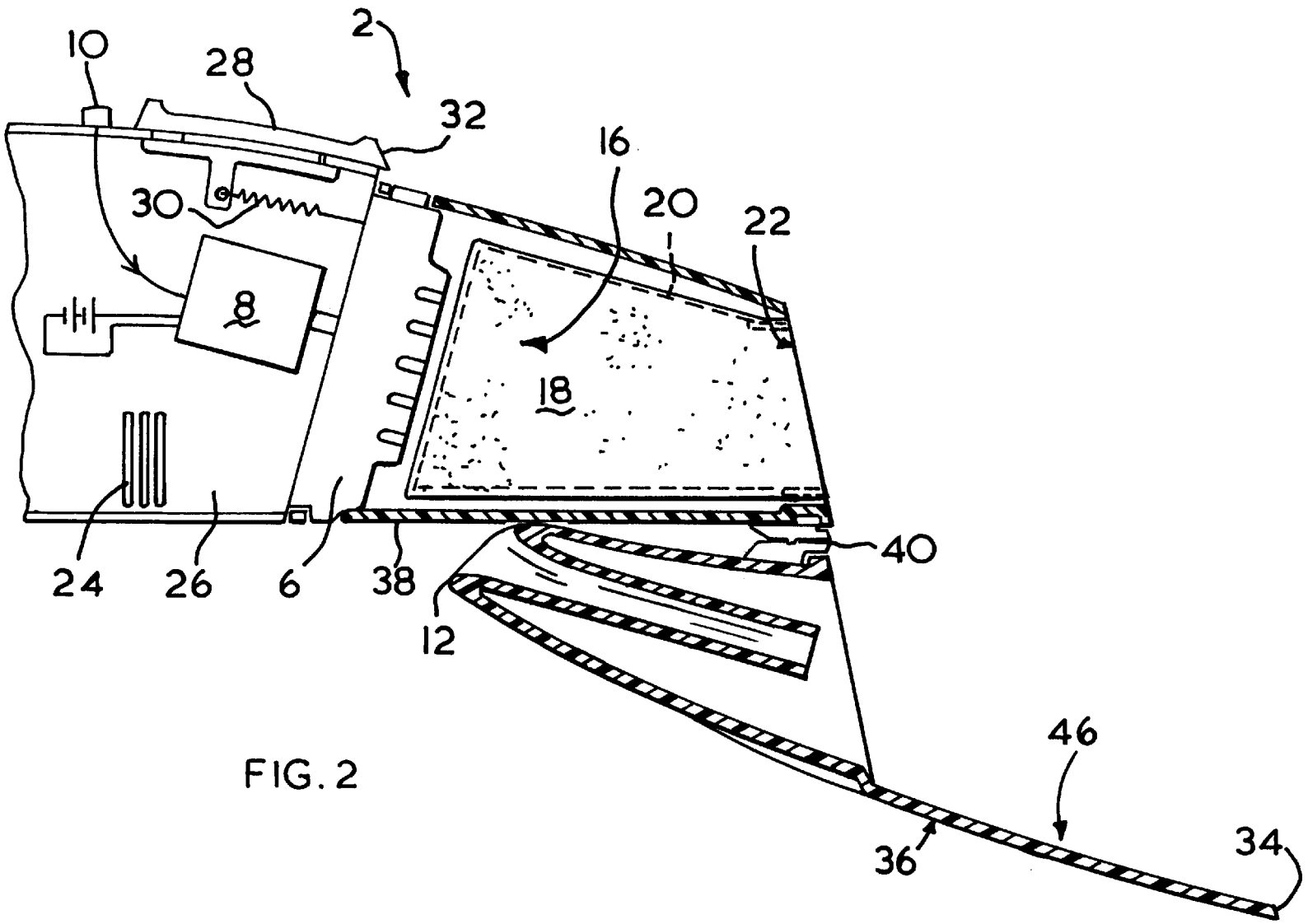
FIG. 2 shows the view of FIG. 1, but with the device opened up into its debris-removal mode.
Figure 3:
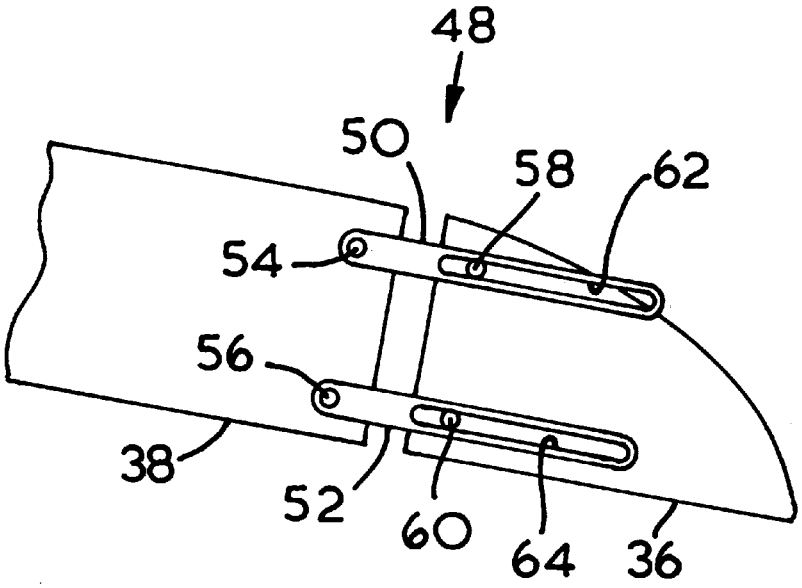
FIG. 3 shows a schematic side view of an alternative embodiment to that of FIGS. 1 and 2.
Figure 4:
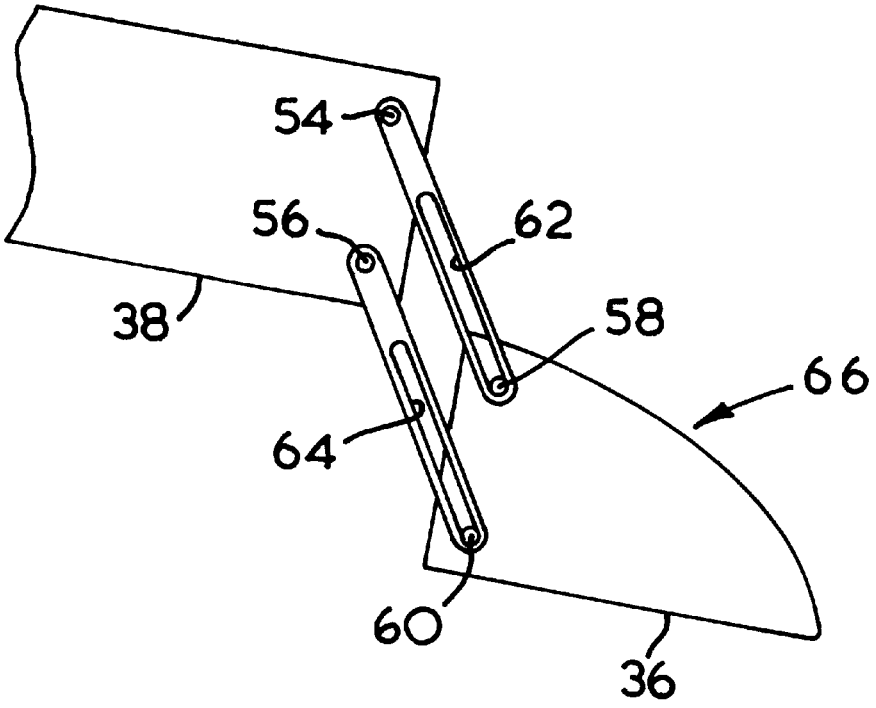
FIG. 4 shows the embodiment of FIG. 3 in its separated state.

Once the debris has been removed from the filter 16, then the portion 16 may be simply rotated about the hinge 40 in an anti-clockwise sense as one views FIG. 2 in order to bring the edge 34 into contact with the edge 32. Sufficient force will cause the lock 28 to move to the left (due to the chamfer of the edge 32) and allow the edge 34 to once again take its seat. The lock will then, under the action of spring 30 move back to its position over the edge 34 and the device may once again be used for vacuum cleaning. It will be apparent that, for example, there is no limitation for the present invention to employ only a single pivot point to work. The invention will equally function if a double-pivoting system is employed. This is shown in FIG. 3 where it can be seen that the two portions 36,38 are now linked via such a double pivot mechanism, 48. The mechanism comprises two arms 50, 52 each of which is pivotally connected at one end thereof via respective rivets 54,56 to the portion 38. The other portion, 36, also bears two rivets 58,60, each of which is coupled to its respective arm 50, 52. The rivets 58, 60 are free to travel within recesses formed part-way along the length of their respective arms 50, 52. As can be seen from FIG. 4, these recesses 62,64 allow the portion 36 to pivotally separate from the portion 38 in order to define a chute 66 along the upper length of the portion 66.

It will be understood that a locking means (not shown) is provided between the portions 38 and 36 in FIG. 3 to allow the two portions to be coupled together during use of the device. Such a locking means is analogous to the sliding lock 28 of FIGS. 1 and 2.

We claim:

1. A hand-held vacuum cleaner comprising: a housing that accommodates an electric motor operable to drive a fan, which fan, when driven, causes an influx of air to the vacuum cleaner through a first opening in the housing, via a filter, to a second opening in the housing for efflux from the housing, wherein the housing includes a first portion having a debris chamber and a second portion pivotally connected to and separable from the first portion in order to remove debris from the filter and the debris chamber, and wherein the second portion moves relative to the first portion and includes a chute through which debris from the filter and the debris chamber may pass.

2. A hand-held vacuum cleaner according to claim 1, further comprising a manually operable detent operable to selectively either couple or release the first and second portions.

3. A hand-held vacuum cleaner according to claim 1, wherein one of the first or second portions provides the first opening in the housing.

4. A hand-held vacuum cleaner according to claim 1, wherein the first and second portions are connected via a pivot disposed on an underside of the housing.

5. A hand-held vacuum cleaner according to claim 1, wherein pivotal separation of the first and second portions is enabled by generation of a moment about a pivotal connection such that the second portion that moves relative to the first portion may come to rest below the housing thereby to provide said chute for debris.

6. A hand-held vacuum cleaner according to claim 5, wherein, in the rest position below the housing, the second portion may be selectively connected to an underside portion of the housing.

7. A hand-held vacuum cleaner according to claim 5, wherein the pivotal connection comprises a hinge.

8. A hand-held vacuum cleaner according to claim 7, wherein the hinge comprises a lug and a corresponding recess for acceptance of the lug to selectively connect the second portion to the underside portion of the housing.

9. A hand-held vacuum comprising:

a fan;

an electric motor operable to drive the fan; and a housing defining influx and efflux openings, the housing including a first portion that accommodates the fan, the motor and a debris filter, and a second portion having an extension member that forms a chute for debris from the filter when the first and second portions are opened via a hinge between the debris filter and the influx opening.

10. A hand-held vacuum cleaner according to claim 9, wherein the chute extends forward of the hinge when the first and second portions are opened.

11. A hand-held vacuum cleaner according to claim 9, further comprising a debris chamber accommodated within the first portion, wherein the hinge is positioned between the debris chamber and the influx opening.

12. A hand-held vacuum cleaner comprising:

a fan;

an electric motor operable to drive the fan; and a housing that accommodates the fan and the electric motor, the housing including a first portion and a second portion pivotally mounted to the first portion about a hinge such that the second portion may come to rest below and be selectively connected to an underside of the housing.

13. A hand-held vacuum cleaner according to claim 12, wherein said second portion has an extension member that partially covers the first portion when the first and second portions are in a closed position and that projects forward of the hinge to form a chute when the second portion rests below the underside of the housing.

* * * * *